US006295815B1

(12) United States Patent
Bechle et al.

(10) Patent No.: US 6,295,815 B1
(45) Date of Patent: Oct. 2, 2001

(54) INTERNAL COMBUSTION ENGINE WITH EXHAUST GAS RECIRCULATION PARTICULARLY FOR MOTOR VEHICLES

(75) Inventors: Sven Bechle, Langenbrettach; Uwe Gärtner, Remshalden, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/447,116

(22) Filed: Nov. 22, 1999

(51) Int. Cl.[7] ..... F02M 25/07

(52) U.S. Cl. ..... 60/605.2; 123/568.12; 123/568.11; 123/568.2

(58) Field of Search ..... 123/568.11, 568.12, 123/568.19, 568.2, 568.23, 568.24; 60/605.2

(56) References Cited

U.S. PATENT DOCUMENTS

| | | | | |
|---|---|---|---|---|
| 4,420,438 | | 12/1983 | Goosen | 261/65 |
| 4,475,524 | * | 10/1984 | Eckert et al. | 123/568.23 |
| 5,520,161 | * | 5/1996 | Klopp | 123/568.24 |
| 5,531,205 | | 7/1996 | Cook et al. | 123/568.24 |
| 5,732,688 | * | 3/1998 | Charlton et al. | 123/568.12 |
| 6,062,205 | * | 5/2000 | Bevan et al. | 123/568.24 |
| 6,079,395 | * | 6/2000 | Coleman | 123/568.12 |
| 6,178,933 | * | 1/2001 | Lavy | 123/568.11 |

FOREIGN PATENT DOCUMENTS

| | | |
|---|---|---|
| 24 55 777 | 8/1976 | (DE) . |
| 32 37 337 | 4/1983 | (DE) . |
| 42 21 449 | 1/1994 | (DE) . |
| 195 24 603 | 8/1996 | (DE) . |
| 0 346 803 | 12/1989 | (EP) . |
| 0 363 021 | 4/1990 | (EP) . |
| 0 682 199 | 11/1995 | (EP) . |
| 2 715 437 | 7/1995 | (FR) . |
| 06 346761 | 12/1994 | (JP) . |
| WO 97/43538 | 11/1997 | (WO) . |

* cited by examiner

*Primary Examiner*—Willis R. Wolfe
(74) *Attorney, Agent, or Firm*—Klaus J. Bach

(57) ABSTRACT

In an internal combustion engine with exhaust gas re-circulation including a fresh air supply duct extending from the charger of a turbocharger to the engine, an exhaust pipe extending from the engine to the turbine of the turbocharger for driving the turbocharger, and an exhaust gas re-circulation pipe extending from the exhaust pipe to the intake duct, the exhaust gas re-circulation pipe includes a flap valve having a pivotally supported flap which, in an open position of the flap valve, is disposed in a plane parallel to the direction of the exhaust gas flow through the flap valve for minimizing the flow resistance in the exhaust gas re-circulation pipe.

11 Claims, 7 Drawing Sheets

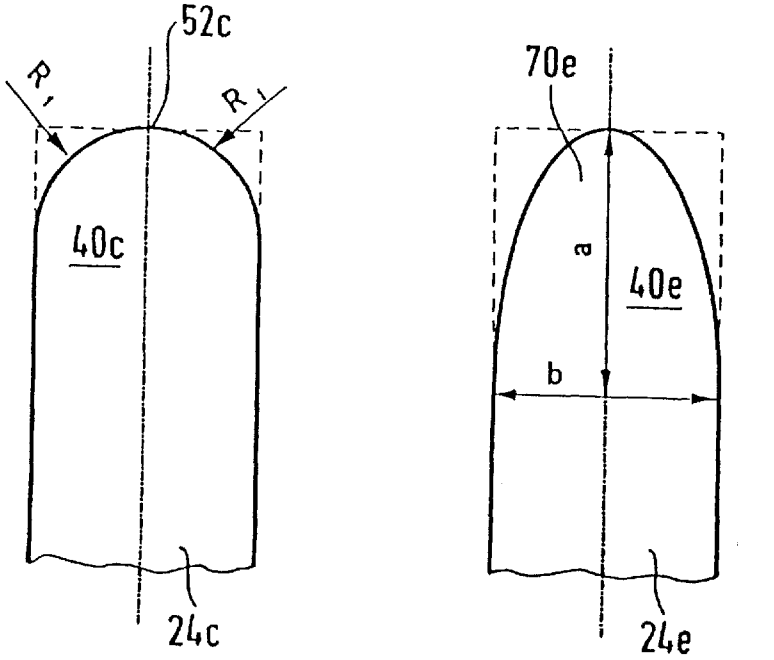
FIG.10
FIG.13
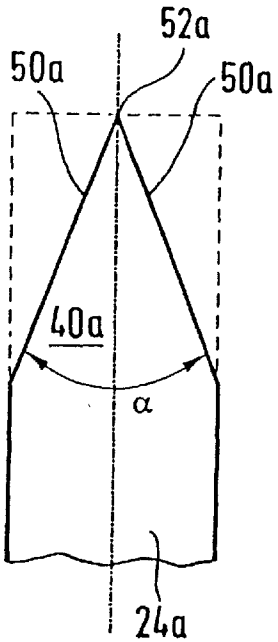
FIG.5
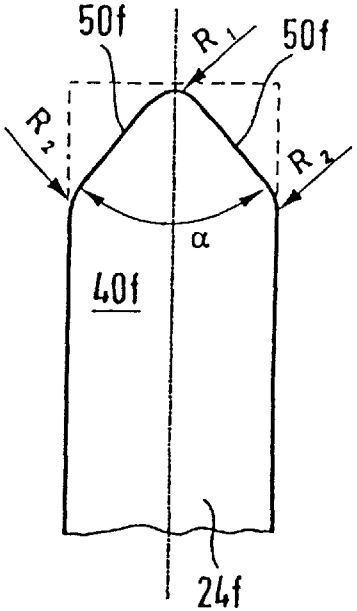
FIG.14

INTERNAL COMBUSTION ENGINE WITH EXHAUST GAS RECIRCULATION PARTICULARLY FOR MOTOR VEHICLES

BACKGROUND OF THE INVENTION

The invention relates to an internal combustion engine, particularly an internal combustion engine with an exhaust gas re-circulation system including an exhaust gas re-circulation line, which branches off an exhaust gas pipe and returns exhaust gas to an engine intake duct and which includes a valve for controlling the re-circulation flow of the exhaust gas.

Such an internal combustion engine is described for example in DE 195 24 603 C1. The known internal combustion engine includes an exhaust gas re-circulation system by way of an exhaust gas re-circulation line, which branches off an exhaust pipe and re-circulates exhaust gases to a charge air intake duct. The exhaust gas re-circulation line includes a shutoff valve which, depending on its position, permits, or blocks, passage of exhaust gases through the re-circulation line. During normal operation with exhaust gas re-circulation, the shut-off valve is closed when the engine power output is above a certain value since otherwise the charge air pressure in the intake duct would be higher than the exhaust gas pressure in the exhaust gas line so that no exhaust gas could flow through the exhaust gas re-circulation line.

The shutoff valve is a plate valve whose valve plate is biased by a valve spring onto an annular valve seat disposed in the exhaust gas re-circulation line. In an embodiment provided for commercial vehicles the shutoff valve opens against the flow direction of the exhaust gas to be re-circulated in order to prevent opening of the valve by the high exhaust gas pressure forces occurring in the exhaust gas duct during engine braking operation. These forces might otherwise exceed the closing forces of the valve spring whereby the valve would be pushed open resulting in a loss of engine braking power.

The shutoff valve is arranged at the point where the exhaust gas re-circulation line branches off the exhaust gas line and includes a tubular valve housing which forms a beginning section of the exhaust gas re-circulation line. The exhaust gas re-circulation line extends then from the valve housing at a right angle so that a valve spring and a valve operating membrane can be arranged in alignment with the tubular housing.

The shutoff valve opens into the exhaust gas line in such a way that the exhaust gas flow can pass the valve plate extending normal to the exhaust gas flow.

The known internal combustion engine has the disadvantage that, when the shutoff valve is open, the valve plate acts as a baffle plate generating a high flow resistance. The deflection of the exhaust gases necessitated by the design of the shutoff valve also results in an increased flow resistance. In order to provide for a flow of exhaust gas from the exhaust pipe to the intake duct, the exhaust gas pressure in the exhaust pipe must be higher than the intake air pressure in the intake duct. The pressure level required to be present in the exhaust pipe for the re-circulation of the exhaust gas depends among others on the flow resistance in the exhaust gas re-circulation line. In order to overcome the relatively high flow resistance caused by the shutoff valve, the pressure in the exhaust pipe must be relatively high to overcome the gas flow resistance which detrimentally affects fuel consumption of the engine.

Furthermore, the shutoff valve of the prior art arrangement is not provided with a firm stop at its open end position and can therefore be subject to oscillations because of pressure pulsations in the exhaust gas flow. As a result the free flow cross-section is reduced and the re-circulated exhaust gas volume becomes too small that is it deviates from the desired value.

In order to facilitate the flow of exhaust gases around the valve plate when the shutoff valve is open, in the arrangement shown in the patent publication the shutoff valve must be arranged exactly at the branch-off location of the exhaust gas re-circulation line and must open into this line. Otherwise, the exhaust gas re-circulation line needs to include a section of increased diameter in which the valve plate is accommodated in the open position of the shutoff valve. However, it is a disadvantage that, in the first case, the position of the exhaust valve is predetermined and cannot be changed, and, in the second case, the manufacturing costs are higher and the arrangement is larger and requires an increased amount of space.

It is the object of the present invention to provide an internal combustion engine with an exhaust gas re-circulation system of the type referred to above which, however, has low flow losses in the exhaust gas re-circulation pipe and wherein the position of the valve in the exhaust gas re-circulation line can be selected freely and in a space-saving manner.

SUMMARY OF THE INVENTION

In an internal combustion engine with exhaust gas re-circulation including a fresh air supply duct extending from the charger of a turbocharger to the engine, an exhaust pipe extending from the engine to the turbine of the turbocharger for driving the turbocharger, and an exhaust gas re-circulation pipe extending from the exhaust pipe to the intake duct, the exhaust gas re-circulation pipe includes a flap valve having a pivotally supported valve flap which, in an open position of the flap valve, is disposed in a plane parallel to the direction of the exhaust gas flow through the flap valve for minimizing the flow resistance in the exhaust gas re-circulation pipe.

The internal combustion engine according to the invention has the advantage that the valve plate extends parallel to the flow in the exhaust gas re-circulation line when the valve is open whereby the cross-section of the valve body in the exhaust gas flow is quite small. As a result, the flow resistance is substantially smaller than that of the valves used in the state of the art arrangements. As a result, the fuel consumption of the engine is reduced.

Since the cross-section of the exhaust gas re-circulation line does not need to be increased to accommodate the valve flap, the valve may be arranged at any place within the exhaust gas re-circulation line. Furthermore, the form and contour of the flap may be easily adapted to the particular conditions in the exhaust gas re-circulation line. The pivot structure of the flap can be realized in a simple arrangement by a shaft on which the flap is mounted and whose ends are rotatably supported in the walls of the exhaust gas re-circulation pipe.

It is particularly advantageous if stops are arranged at the inside of the re-circulation pipe, which are sealingly engaged by the valve flap when the valve is closed. A tight closing of the flap valve prevents a pressure equalization between the intake charge air side and the exhaust side of the internal combustion engine which is advantageous for the dynamic operation of the engine.

In a preferred embodiment of the invention, the flap of the valve has a cross-section, which is streamlined; preferably, it has a symmetrical drop-like shape. With this measure, the flow resistance of the flap can be substantially reduced.

BRIEF DESCRIPTION OF THE DRAWINGS

FIG. 5 shows the cross-section of a flap edge of the valve flap shown in FIGS. 3 and 4, FIG. 10 shows the cross-section of a flap edge of the valve flap shown in FIGS. 8 and 9, FIG. 13 shows the cross-section of the elliptical front edge of the valve flap of FIG. 11, and FIG. 14 shows, in cross-section, a wedge shaped edge of a valve flap.

DESCRIPTION OF PREFERRED EMBODIMENTS

Figure 1:
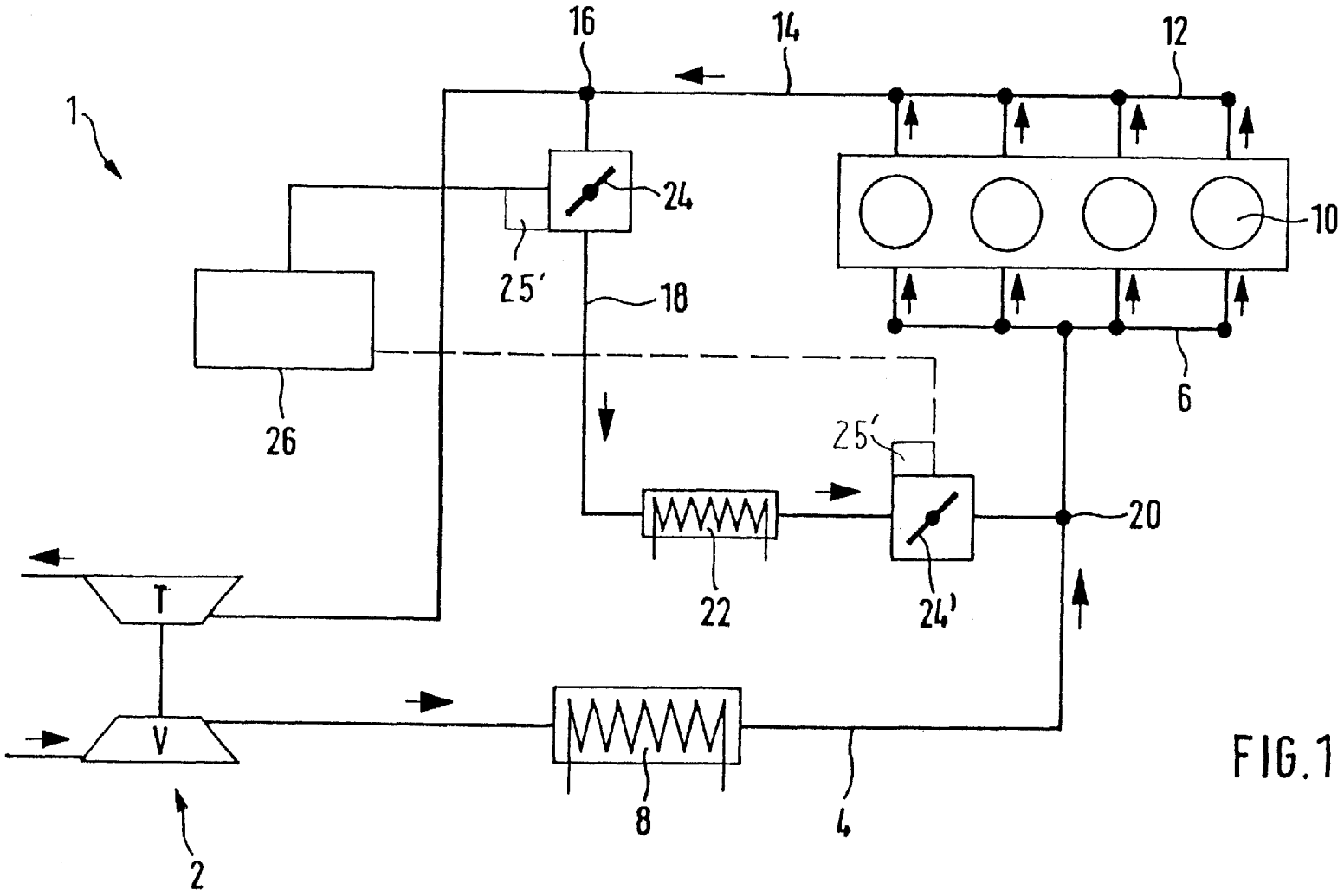
FIG. 1 shows schematically an internal combustion engine with exhaust gas re-circulation.

The internal combustion engine 1 shown schematically in FIG. 1 is used, in its preferred application, for driving a commercial vehicle. The internal combustion engine 1 includes an exhaust gas turbocharger 2 with a compressor V by which compressed fresh air is supplied to an intake manifold 6 by way of a fresh air supply duct 4. An inter-cooler 8 is arranged in t h e fresh air supply duct 4 between the compressor V and the intake manifold 6. After combustion of the fuel/air mixture in the cylinders 10 of the internal combustion engine 1, the exaust gases generated thereby are discharged by way of an exaust manifold 12 and an exhaust pipe 14 to a turbine T of the exhaust gas turbocharger 2. The turbine T drives the compressor V.

At a branch location 16 of the exhaust pipe 14 upstream of the turbine T, an exhaust gas re-circulation line 18 branches off the exhaust pipe 14 and extends to a jointure 20 of the fresh air supply duct 4 downstream of the inter-cooler 8. Exhaust gases returned hereby to the fresh air supply duct 4 again participate in the combustion in the cylinders 10, whereby the $NO_x$, emissions of the internal combustion engine are reduced. The re-circulation line 19 includes also a heat exchanger 22 in which the re-circulated exhaust gases are cooled.

Between the branch location 16 of the exhaust pipe 14 and the heat exchanger 22, the exhaust gas re-circulation line 18 includes a flap valve 24 by which the exhaust gas re-circulation flow can be controlled. Alternatively, such a flap valve 24 may be arranged between the exhaust gas heat exchanger 22 and the jointure 20 of the exhaust gas re-circulation line with the fresh air supply duct 4. The flap valve 24, 24' is operated by way of a control motor 25, 25' by a control signal which is generated by a control unit 26 depending on the respective engine operating point. Alternatively, the control signal could be generated depending on the likely exhaust gas composition as calculated from the operating parameters of the internal combustion engine 1.

Figure 2:
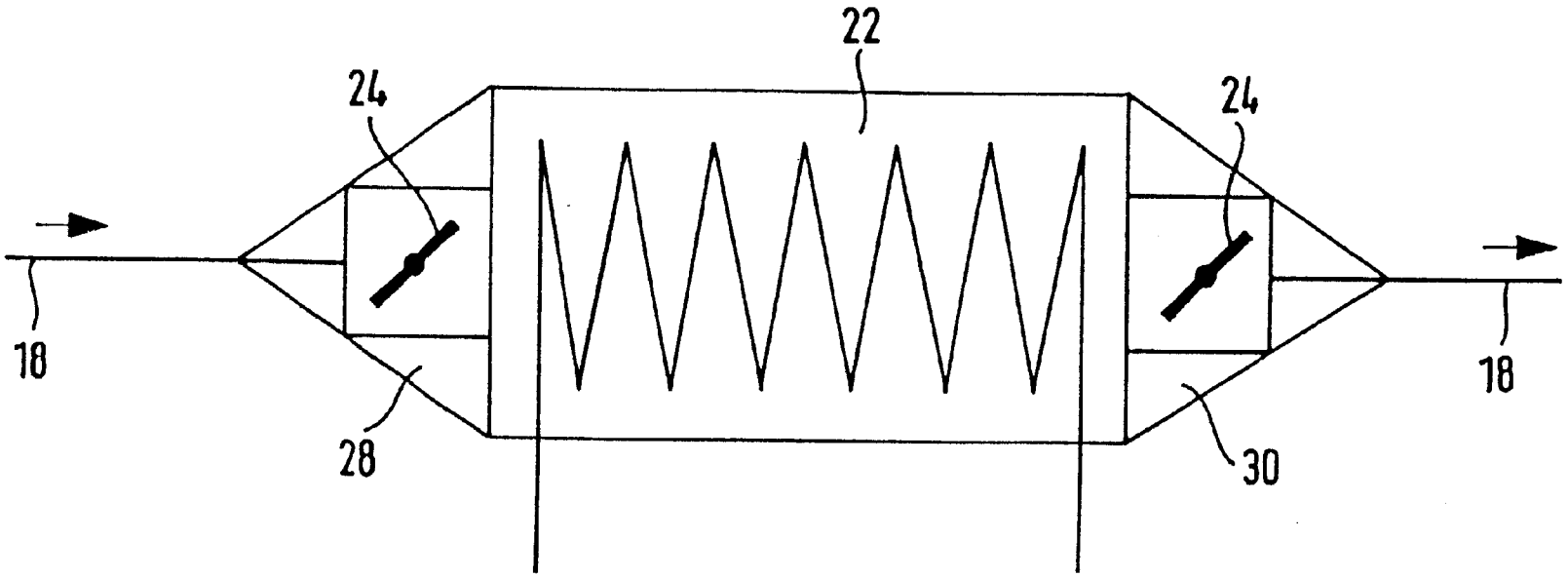
FIG. 2 shows a part of FIG. 1 with an exhaust gas heat exchanger and valves incorporated therein.

As shown in the enlarged view of the exhaust gas heat exchanger 22 given in FIG. 2, the flap valve 24 can be arranged in flow direction directly in front of the exhaust gas heat exchanger 22, that is in its inlet opening 28 or directly after the exhaust gas heat exchanger 22 that is in its outlet opening 30. Alternatively, several flap valves 24 may be arranged in series or in parallel in the exhaust gas re-circulation line in side-by-side relationship.

Figure 4:
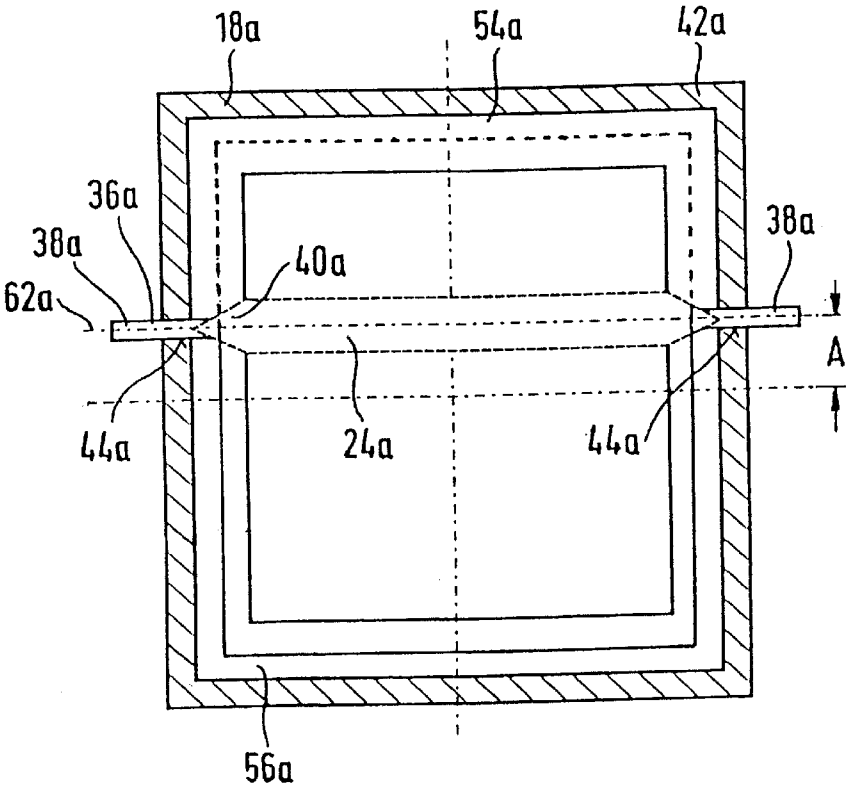
FIG. 4 is a view in flow direction of the valve shown in FIG. 3.
Figure 3:
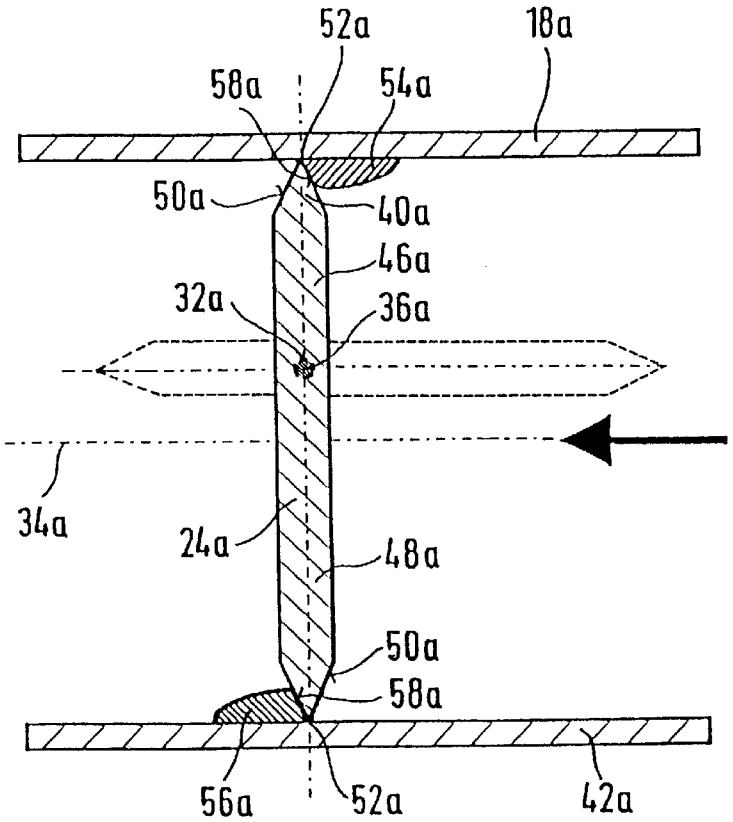
FIG. 3 is a cross-sectional view of a valve installed in an eccentric fashion in a flow passage provided with stops.

FIGS. 3 and 4 show a preferred embodiment of a flap valve 4 according to the invention, wherein the full lines show the valve flap 24*a* in a closed position and the dashed lines show the valve flap 24*a* in an open position. The valve flap 24*a* is rectangular and has an outer diameter corresponding to the inner diameter of the exhaust gas re-circulation line 18*a* which has a rectangular cross-section. The valve flap 24*a* includes a central bore 32*a* receiving a shaft 36*a*, which extends normal to the center axis 34*a* of the exhaust gas re-circulation line 18*a* and has free ends 38*a* projecting beyond the edges 40*a* of the valve flap 24.

The free ends 38*a* of the shaft 36*a* are rotatably supported in bearing structures 44*a* formed in the wall 42*a* of the exhaust gas re-circulation line. The valve flap 24*a* is preferably pressed onto the shaft 36*a* so that it is supported pivotally together with the shaft 36*a* relative to the exhaust gas re-circulation line 18*a*. Alternatively, the valve flap 24*a* may be welded to the shaft 36*a* or it may be screwed thereto. A control motor for operating the valve flap 24*a* may be welded to the shaft 36*a* which extends beyond the outer circumference of the exhaust gas re-circulation line 18*a* such that the shaft 36*a* and the valve flap 24*a* can be operated by the control motor.

As shown in FIGS. 3 and 4, the valve flap 24*a* is eccentrically supported. The bore 32*a* of the valve flap 24*a* receiving the horizontal shaft 36*a* is arranged at a distance A from the center axis of the exhaust gas re-circulation pipe 18*a* (upwardly as shown in the figures) so that the valve flap 24*a* has a shorter upper portion 46*a* and a longer lower portion 48*a*.

The valve flap 24*a* is preferably flat or thin, that is, the thickness of the valve flap 24*a* is small when compared to its diameter. As shown in FIG. 5, the outer flap edge 40*a* has wedge-like opposite edges 52*a* formed by angled wedge surfaces 50*a*. The wedge angle $\alpha$ is preferably between 20 and 70°.

As shown in FIGS. 3 and 4, the exhaust gas re-circulation line 18*a* includes at its inner circumference an upper stop structure 54*a* and a lower stop structure 56*a*. The upper and lower stop structures 54*a*, 56*a* are displaced relative to each other in the longitudinal direction of the exhaust gas re-circulation pipe 18*a*, so that, in its closed position, the valve flap 24*a* engages with its upper edge the upper stop structure 54*a* at the side of the flap facing the exhaust gas side and, with its lower edge, the lower stop structure 56*a* at the side of the flap facing the charge air side. With the eccentric pivot support arrangement of the valve flap 24*a*, the gas pressure forces in the exhaust pipe 14 generate on the valve flap 24*a*, when closed, a torque by which the valve flap

24*a* is pressed against the upper and the lower stop structures 54*a*, 56*a*, whereby the valve flap 24*a* is held in a closed position. In this way, an unwanted opening of the valve flap 24*a* for example during engine braking operation is prevented.

The upper and the lower stop structures 54*a*, 56*a* have engagement surfaces 58*a*, which are oppositely directed and which are sealingly engaged by the valve flap edges 50*a* when the valve flap is in a closed position. In this way, the flap edges 50*a* and the respective engagement surfaces 58*a* form complementary seal surfaces. In addition, the end edge 52*a* of the flap edge portion 40*a* seals with respect to the inner surface of the pipe wall 42*a* of the exhaust gas re-circulation pipe 18*a*. The facing engagement surfaces 58*a* of the upper and the lower stop structures 54*a*, 56*a* engage the edge portion 52*a* of the closed valve flap 24*a* at opposite sides. Furthermore, the free ends of the upper and lower stop structures are in contact with the inner wall of the exhaust gas re-circulation pipe along a plane 62*a*, which includes the shaft 36*a* and extends parallel to the center axis 34*a* of the exhaust gas re-circulation line 4*a*, as shown in FIGS. 3 and 4. The upper and the lower stop structures 54*a*, 56*a* together form a circumferentially extending engagement structure within the exhaust gas re-circulation pipe 18*a*.

As apparent from FIG. 3, the valve flap 24 is pivoted to its open position in a counter-clockwise direction so that then the longer lower portion 48*a* of the flap 24 is moved against the flow direction of the exhaust gases which is indicated by the arrow. The valve flap 24*a* extends in its open position parallel to the exhaust gas re-circulation flow. The control motor 25, 25' holds the valve flap 24*a* in its open position against any closing force resulting from the eccentric support of the valve flap 24*a*.

Figure 7:
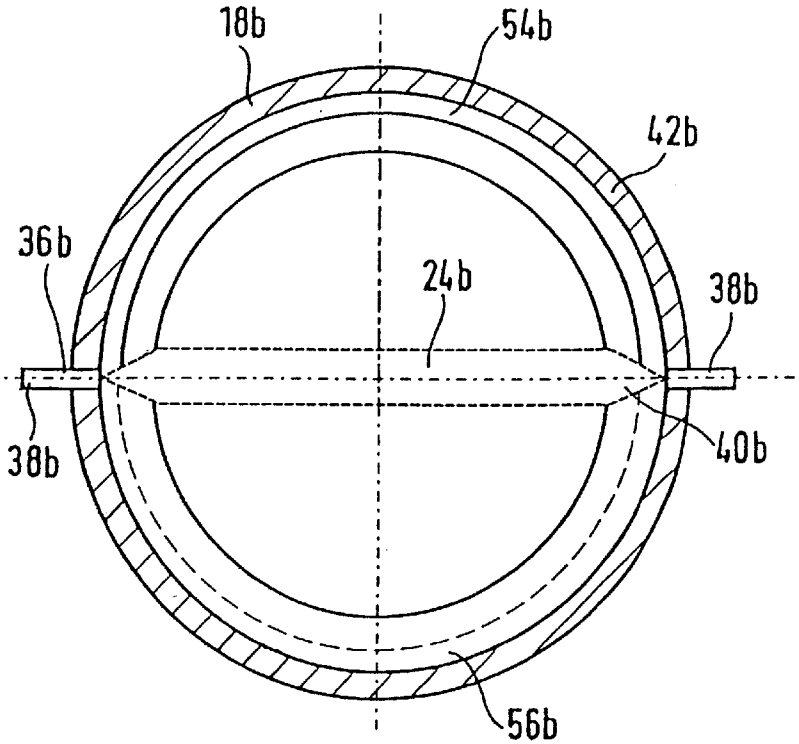
FIG. 7 is a view in flow direction of the valve shown in FIG. 6.
Figure 6:
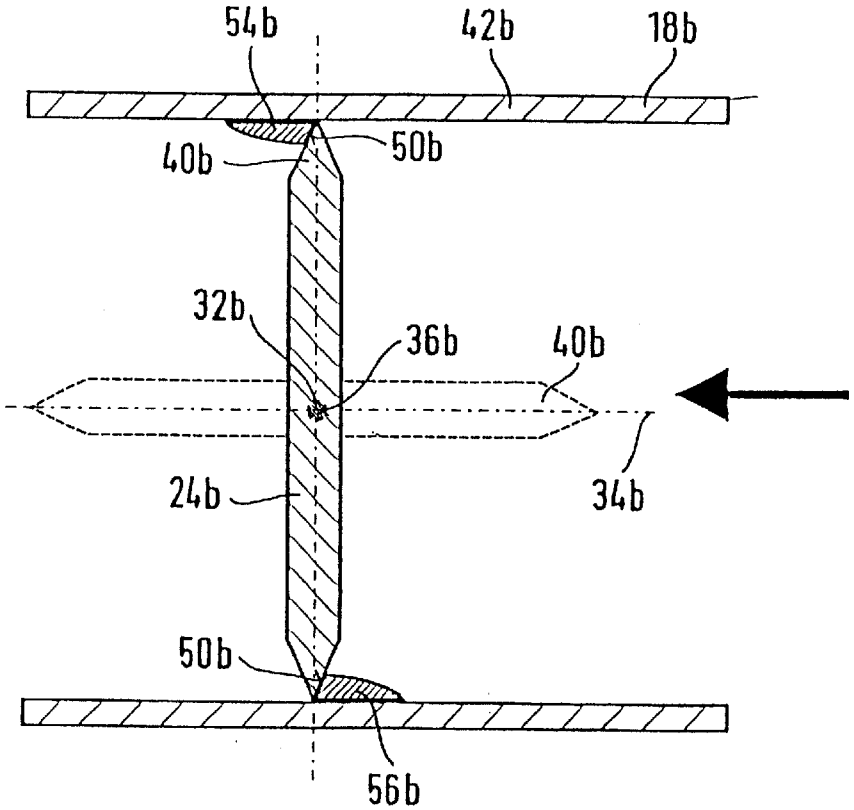
FIG. 6 is a cross-sectional view of a valve with stops for a circular flap pivotally supported about a center axis.

In the embodiment of the invention as shown in the FIGS. 6 and 7, the valve flap 24*a* is circular and also the cross-section of the exhaust gas re-circulation line 18*b* is circular. In contrast to the preferred embodiment, the valve flap 24*b* is centrally supported that is the bore 32*b* for receiving the horizontal shaft 36*b* coincides with the centerline of the valve flap. The circumferential edge 40*b* of the circular flap 24*b* also has a wedge shape as shown in FIG. 5. Again, an upper and a lower stop structures 54*b*, 56*b* are provided, which cooperate with the wedge-like edges 50*b* of the valve flap 24*b* in a sealing fashion. In its open position, the valve flap 24*b* is pivoted by the control motor in a clockwise direction to a position in which it is parallel to the flow direction and disposed in a plane receiving the center line 34*b* of the exhaust gas re-circulation pipe 186. Then the upper half of the valve flap 24*b* and particularly its streamlined flap edge 40*b* extends toward the flow direction of the exhaust gas indicated by the arrow.

Figure 9:
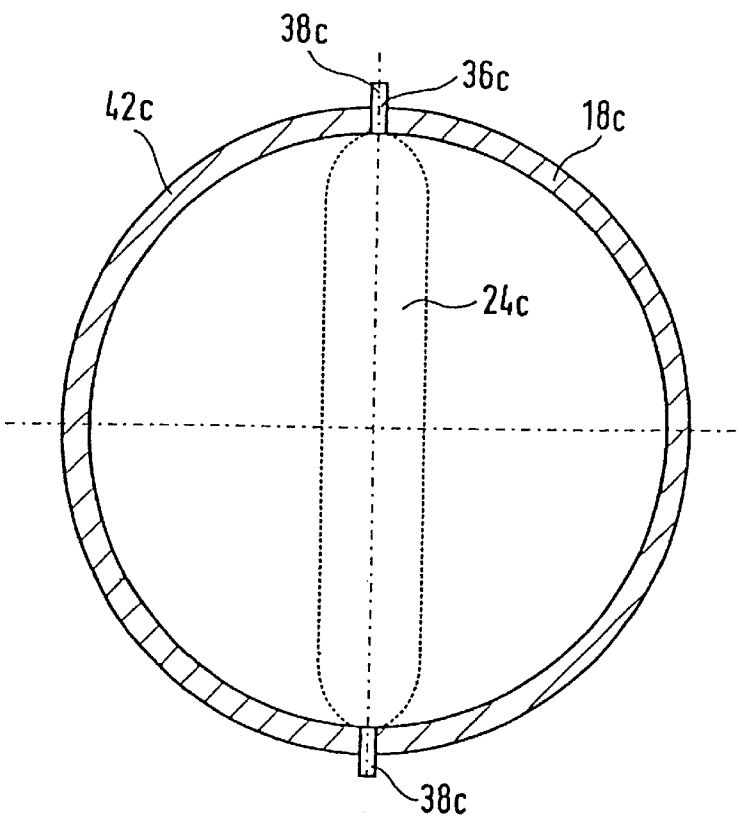
FIG. 9 is a view, in flow direction, of the valve shown in FIG. 8.
Figure 8:
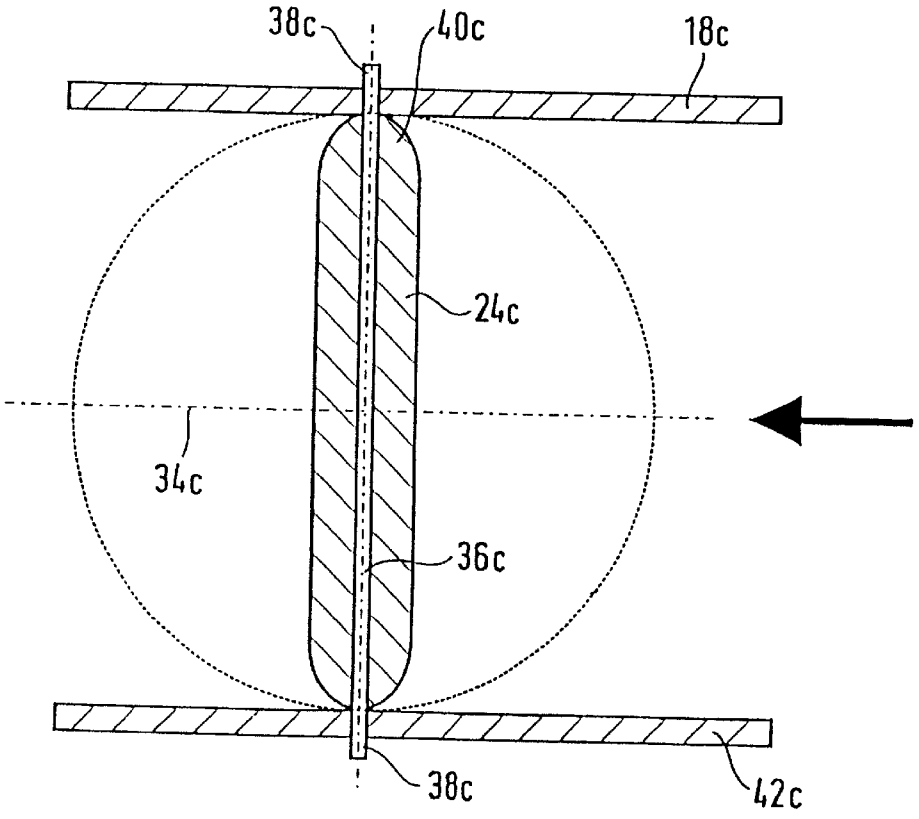
FIG. 8 is a cross-sectional view of a valve pivotally supported about a center axis.

FIGS. 8 and 9 show another embodiment of a valve flap 24*c* in an exhaust gas re-circulation line 18*c* with circular cross-section. In contrast to the previous embodiments, no stop structures are provided and the valve shaft is arranged vertically. Also, the outer flap edge 40*c* is not wedge shaped, but is rounded. In accordance with FIG. 10, the flap edge 40*c* has a cross-sectional profile with curvature radii $R_1$ and $R_2$, which are identical and a seal surface 52*c* is formed in the center thereof. When the valve flap 24*c* is closed the seal surface 52*c* is in sealing engagement with the inner surface of the pipe wall 42*c* of the exhaust gas re-circulation pipe 18*c*. Although not shown in the drawings for this particular embodiment, stop structures and additional seal structures for engagement with the valve flap 24*c* could be provided also in this case.

Figures 11, 12:
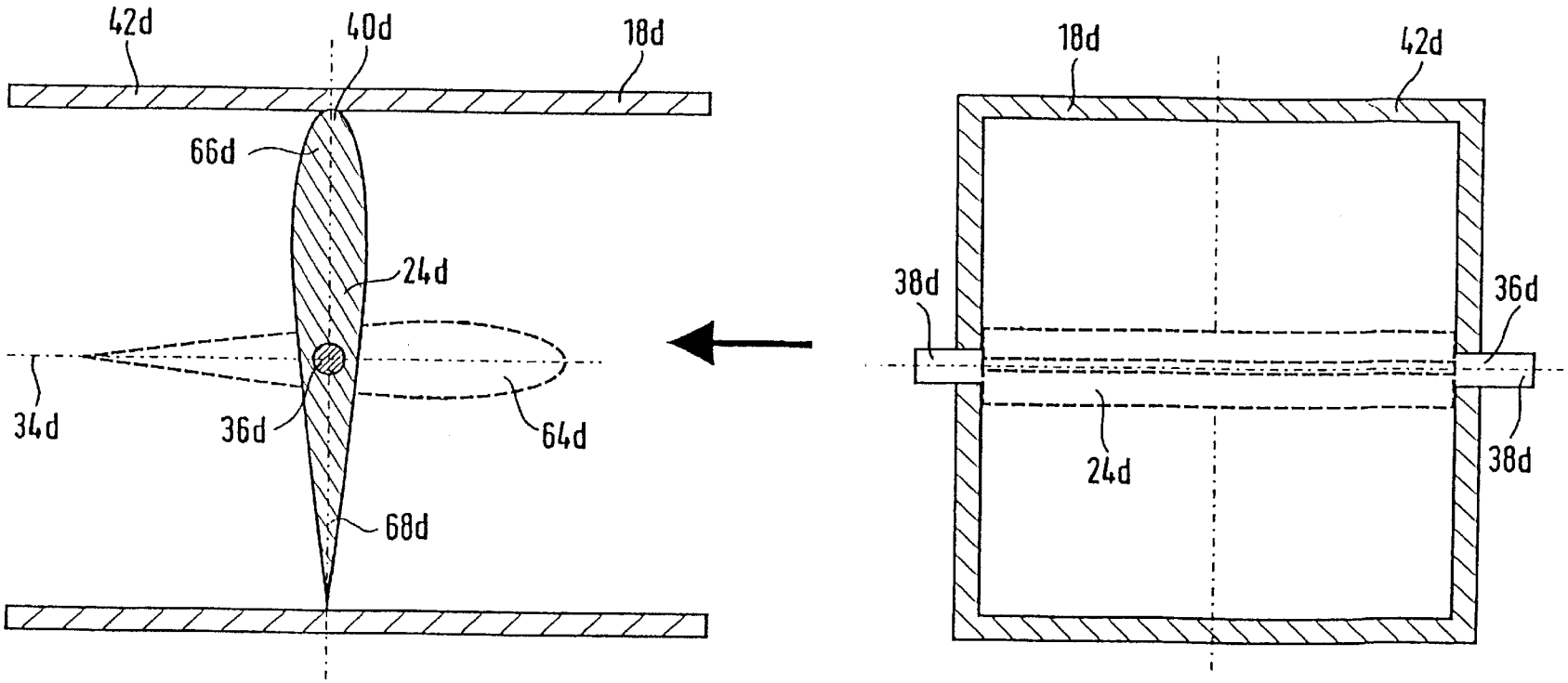
FIG. 11 is a cross-sectional view of a valve with streamlined flow cross-section.
FIG. 12 is a view, in flow direction, of the valve shown in FIG. 11.

FIGS. 11 and 12 show another embodiment of a valve flap 24*d*, which has a streamlined shape 64d and is mounted in an exhaust gas re-circulation pipe 18*d* of rectangular cross-section so as to be pivotable around a horizontal axis of a shaft 36*d*. The shaft 36*d* extends through the center of the valve flap 24*d*. The streamlined profile 64*d* includes a head portion 66*d*, which extends toward the flow of the exhaust gas when the valve flap is in an open position. The opposite end of the valve flap profile 64*d*, that is the foot end thereof, is wedge-shaped so that the valve flap has a drop-shaped cross-section. The drop-shaped profile is symmetrical in the embodiment shown in FIG. 11 so that no flow-generated vertical forces act on the valve flap 24*d* when it is in its open position. Alternatively, the valve flap 24*d* may have a wing-like profile and valve flap stops may be provided for engagement with the valve flap in the open or the closed position of the valve flap.

FIG. 13 shows the flap edge 40*c* of another embodiment of a valve flap 24*e* according to the invention wherein the edge of the valve flap 24*e* has an elliptical shape in cross-section. The elliptical profile 70*e* has a major axis a extending in the longitudinal direction of the valve flap and a minor axis b extending normal thereto.

FIG. 14 shows a valve flap edge 40*f* of an embodiment of a valve flap 24*f*, which is again wedge-shaped with a wedge angle $\alpha$ in the range of 40 to 80°. The transition areas of the wedge surfaces 50*f* however are rounded having radii $R_1$, $R_2$ and $R_3$.

The profiles of valve flap edges 40*a*, 40*c*, 40*e*, 40*f* as shown in FIGS. 5, 10, 13 and 14 all have good flow properties and extend toward the flow of the exhaust gas when the valve flap is in its open position.

The valve flaps 24*a*, 24*b*, 24*c*, 24*e*, 24*f* are not limited to be in fully closed or fully open positions. Rather the valve flaps can assume any intermediate position depending on the control provided by the control unit 26, so that the exhaust gas re-circulation line cross-section can be controlled in a continuous manner.

What is claimed is:

1. An internal combustion engine with exhaust gas re-circulation, including an exhaust gas turbocharger having an exhaust gas turbine and a fresh air charger, a fresh air supply duct connected to said fresh air charger for supplying combustion air to said engine, an exhaust gas pipe extending from said engine to said exhaust gas turbine for driving said turbocharger, an exhaust gas re-circulation line branching off said exhaust gas pipe upstream of said exhaust gas turbine and leading to said fresh air supply duct downstream of said fresh air charger, and a flap valve arranged in said exhaust gas re-circulation line and including a pivotally supported valve flap which, in an open position of said flap valve, is disposed in a plane extending parallel to the direction of the exhaust gas flow through said exhaust gas re-circulation line and a first stop structure and a second stop structure provided on the inner wall of said exhaust gas re-circulation line displaced with respect to each other such that, in a closed position of said valve flap, the exhaust side of said flap engages the first stop structure and the intake side of said flap engages the second stop structure, said shaft being eccentrically mounted to said valve flap and pivotally supported such that said valve flap is biased by the exhaust gas pressure against the first and second stop structures when said valve flap is closed.

2. An internal combustion engine according to claim 1, wherein said flap has a streamlined cross-section in a plane extending in the flow direction of said exhaust gas normal to said valve flap.

3. An internal combustion engine according to claim 1, wherein said exhaust gas re-circulation line includes an exhaust gas heat exchanger and said flap valve is incorporated in said exhaust gas heat exchanger.

4. An internal combustion engine according to claim 1, wherein the thickness of said valve flap is small in comparison with the diameter of said valve flap.

5. An internal combustion engine according to claim 1, wherein said valve flap is mounted on a shaft which extends normal to a center axis of said exhaust gas re-circulation line and to which said valve flap is connected for rotation therewith, said shaft being pivotally supported in the walls of said exhaust gas re-circulation line and connected to a control motor so as to be pivoted thereby.

6. An internal combustion engine according to claim 5, wherein said exhaust gas re-circulation line has a given cross-section and said valve flap has a shape corresponding to the cross-section of said exhaust gas re-circulation line, such that the exhaust gas re-circulation line is fully closed in the closed position of said valve flap.

7. An internal combustion engine according to claim 6, wherein said valve flap has a streamlined shape so as to minimize its flow resistance when said valve flap is in an open position.

8. An internal combustion engine according to claim 7, wherein said valve flap has edges of a wedge-shaped cross-section.

9. An internal combustion engine according to claim 7, wherein said valve flap has rounded edges.

10. An internal combustion engine according to claim 7, wherein said valve flap has eliptically shaped edges.

11. An internal combustion engine according to claim 7, wherein said valve flap has a drop-shaped cross-section.

* * * * *